US007783220B2

(12) United States Patent
Tateishi et al.

(10) Patent No.: US 7,783,220 B2
(45) Date of Patent: Aug. 24, 2010

(54) ROLLER DRIVE CONTROL METHOD OF FIXING APPARATUS AND FIXING APPARATUS

(75) Inventors: Yoshinobu Tateishi, Nara (JP); Yasuhiro Takai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 222 days.

(21) Appl. No.: 11/839,621

(22) Filed: Aug. 16, 2007

(65) Prior Publication Data

US 2008/0253790 A1 Oct. 16, 2008

(30) Foreign Application Priority Data

Aug. 24, 2006 (JP) ..... 2006-228189

(51) Int. Cl.
*G03G 15/20* (2006.01)

(52) U.S. Cl. ..... 399/70; 399/99; 399/323

(58) Field of Classification Search ..... 399/71, 399/99, 323, 70
See application file for complete search history.

(56) References Cited

U.S. PATENT DOCUMENTS 6,181,890 B1 * 1/2001 Kataoka et al. ..... 399/67
7,299,001 B2 * 11/2007 Yamazaki ..... 399/327

FOREIGN PATENT DOCUMENTS

| | | | |
|---|---|---|---|
| JP | 05107978 A | * | 4/1993 |
| JP | 2003-156967 | | 5/2003 |
| JP | 2005-099426 | | 4/2005 |

OTHER PUBLICATIONS

English Abstract of JP 05107978 A.*
English Abstract of JP 0510978 A, published Apr. 1993; NOTE: this document was cited heretofore (see, PTO-892 dated Jun. 25, 2009) without the publication date; this document has previously been mailed to Applicant and is currently recorded in the application file.*

* cited by examiner

*Primary Examiner*—David P Porta
*Assistant Examiner*—Bryan P Ready
(74) *Attorney, Agent, or Firm*—Renner, Otto, Boisselle & Sklar, LLP

(57) ABSTRACT

In one embodiment, a predetermined period different from a fixing process period in which fixing of toner to recording paper is carried out is set as a toner removal period, and during the toner removal period a hot roller and a pressure roller are intermittently rotated, and separation claws in contact with the rollers are caused to vibrate by the intermittent rotation of the rollers such that toner adhered to the separation claws is caused to drop due to this and is removed. Also, faces of the separation claws that oppose the surfaces of the hot roller and the pressure roller are set in a convex shape.

8 Claims, 4 Drawing Sheets

ROLLER DRIVE CONTROL METHOD OF FIXING APPARATUS AND FIXING APPARATUS

CROSS-REFERENCE TO RELATED APPLICATIONS

This application claims priority under 35 U.S.C.§119(a) on Patent Application No. 2006-228189 filed in Japan on Aug. 24, 2006, the entire contents of which are hereby incorporated by reference.

BACKGROUND OF THE INVENTION

1. Field of the Invention

The present invention relates to roller drive control methods of fixing apparatuses and fixing apparatuses in electrophotographic image forming apparatuses.

2. Description of the Related Art

In this type of fixing apparatus, while recording paper is sandwiched and transported in a nip region between a pair of fixing rollers, the recording paper is subjected to heat and pressure by the fixing rollers so as to thermally fuse and fix toner onto the recording paper.

However, not all the toner is fused and fixedly attached onto the recording paper by the fixing process, and a small amount of toner transfers and adheres to the fixing roller side since the fixing rollers have a high surface temperature. For this reason, ordinarily a cleaning apparatus is provided that removes residual toner on the fixing rollers.

Conventional cleaning apparatuses involve removing residual toner on the fixing rollers using blade cleaning or felt cleaning or the like, but with techniques such as these, even when residual toner on the fixing rollers is removed, toner that has once adhered to the blade or the felt sometimes ends up returning to the fixing rollers.

Consequently, web cleaning techniques have been proposed. In these web cleaning techniques, a web sheet constituted by a thin cloth is wound onto a feed-out roller and one end of the web sheet is connected to a take-up roller, then the web sheet is fed out from the feed-out roller and is taken up by the take-up roller and the web sheet is caused contact the fixing rollers during the feeding out and taking up so as to remove extraneous matter on the fixing rollers.

On the other hand, sometimes recording paper that has passed through the nip region stays adhered to the fixing rollers and does not separate. For this reason, as shown in FIG. 6, a separation claw 202 is provided in a vicinity of a surface of a fixing roller 201, and a leading edge of the recording paper is separated from the surface of the fixing roller 201 by the separation claw 202. A leading edge of the separation claw 202 is formed having an acute angle such that this leading edge of the separation claw 202 inserts easily between the leading edge of the recording paper and the surface of the fixing roller 201.

Furthermore, in FIG. 6 the surface of the separation claw 202 that opposes the surface of the fixing roller 201 is formed flat, but this surface may be formed in a concave shape so as to skirt the surface of the fixing roller 201 such that the separation claw 202 is arranged even closer to the surface of the fixing roller 201 and so that the leading edge of the separation claw 202 inserts easily between the leading edge of the recording paper and the surface of the fixing roller 201.

However, it is necessary for this separation claw to be provided in a vicinity of the nip region between the fixing rollers, and the arrangement position thereof is upstream from the cleaning apparatus in the rotation direction of the fixing rollers. Thus, before the residual toner on the fixing rollers is removed, a portion of it adheres to the separation claw such that a large amount of toner adheres to and accumulates on the separation claw.

When the separation claw makes contact with the leading edge of the recording paper that has come passing through the nip region, the toner that has adhered to and accumulated on the separation claw ends up adhering to and soiling the leading edge of the recording paper.

Furthermore, when a lump of toner that has adhered to and accumulated on the separation claw becomes large, it may drop and adhere to the surface of the fixing rollers. The large lump of toner on the surface of the fixing rollers cannot be fully removed by the cleaning apparatus at one time and may get stuck with peripheral components such as temperature detecting thermistors provided around the surface of the fixing rollers, which may be a cause of damage to the peripheral components.

For this reason, a heater is provided in the separation claw in JP 2003-156967A to heat the separation claw and even when toner adheres to the separation claw, the toner is immediately heated and melted so as to return to the surface of the fixing rollers. This discourages soiling of the leading edge of the recording paper and damage to peripheral components by adhesion of large lumps of toner to the surface of the fixing rollers.

However, when using a heater to heat the separation claw in the manner of JP 2003-156967A, it is necessary to provide a sensor to detect the temperature of the separation claw and to control the temperature of the separation claw, which makes it impossible to avoid increasing the number of components and complicating the control thereof.

Furthermore, along with increasing speeds in image forming apparatuses there have been increasing numbers of sheets of recording paper to be processed by the fixing apparatuses, which increases the amount of heat of the fixing rollers, and since the power consumption involved for that has increased close to the rating for commercial AC power, it is undesirable to invite further increases in the amount of heat for heating the separation claw.

SUMMARY OF THE INVENTION

An object of the present invention is to provide a roller drive control method of a fixing apparatus and a fixing apparatus capable of removing toner that has adhered to the separation claw without providing a heater to the separation claw.

A roller drive control method of the present invention includes a roller drive control method of a fixing apparatus in which a separation claw for separating recording paper is arranged in a vicinity of a surface of at least one of fixing rollers that sandwich and transport the recording paper to cause toner to fix onto the recording paper, provided with: a fixing process step of carrying out fixing of toner onto the recording paper in a fixing process period, and a toner removal step of removing toner adhered to the separation claw, in a toner removal period, which is different from the fixing process period, wherein the fixing rollers are rotationally driven such that a rotational state of the fixing rollers is different in the fixing process step and the toner removal step.

Furthermore, in the present invention, the fixing rollers may be rotationally driven such that the fixing rollers intermittently rotate in the toner removal period.

Further still, the toner removal period may be set to be during warming up of the fixing apparatus, which is carried out before the fixing process period, or after the fixing process period.

Furthermore, in the present invention, the toner removal period may be set at a length in which the fixing rollers rotate one or more times.

Further still, in the present invention, the toner removal period may be set to be during warming up of the fixing apparatus, which is carried out before the fixing process period, and after a surface temperature of the fixing rollers has reached a softening temperature or a melting temperature of the toner, or higher.

Furthermore, in the present invention, the intermittent rotation of the fixing rollers may be performed at a period such that the separation claw on the surface of the fixing roller vibrates.

Further still, in the present invention, when a rotation time of the fixing rollers for the intermittent rotation of the fixing rollers is assumed to be A and a stopping time of the fixing rollers is assumed to be B, the rotation time A and the stopping time B may be set so as to satisfy expressions (1) and (2) below:

$$(2 \text{ to } 2.5)\times A \leqq B \quad (1)$$

$$2.0 \text{ sec} > B > 6.0 \text{ sec} \quad (2)$$

Furthermore, in the present invention, a face of the separation claw opposing the surface of the fixing roller may be a convex shape.

Next, a fixing apparatus according to the present invention is provided with fixing rollers that sandwich and transport recording paper to cause toner to fix onto the recording paper, and a separation claw that is arranged in a vicinity of a surface of at least one of the fixing rollers for separating the recording paper and whose face opposing the surface of the fixing roller is a convex shape.

Furthermore, in the present invention, it is preferable that a gap between the surface of the fixing roller and a leading edge of the separation claw is narrower than a thickness of the recording paper.

Further still, in the present invention, a portion of a convex face of the separation claw may contact the surface of the fixing roller.

Furthermore, in the present invention, the fixing rollers may be rotationally driven such that the fixing rollers intermittently rotate.

With a roller drive control method thus configured according to the present invention, a predetermined period different from the fixing process period, in which fixing of the toner onto the recording paper is carried out, is set as a toner removal period for removing toner that has adhered to the separation claw, and the fixing rollers are rotationally driven such that a rotational state of the fixing rollers is different in the fixing process period and the toner removal period. For this reason, in the toner removal period, the rotational state of the fixing rollers can be set that is appropriate for removing toner that has adhered to and accumulated on the separation claw, and toner that has adhered to and accumulated on the separation claw can be removed without using components such as heaters or the like.

For example, in the toner removal period, when the fixing rollers are rotationally driven so that the fixing rollers intermittently rotate, the separation claws in contact with the fixing rollers vibrate along with the intermittent rotation of the fixing rollers and due to this vibration toner that has adhered to and accumulated on the separation claw can be separated and made to drop.

Furthermore, when the toner removal period is set to be during warming up of the fixing apparatus, which is carried out before the fixing process period, or after the fixing process period, it is not necessary to influence an ordinary fixing process.

Further still, when the toner removal period is set at a length in which the fixing rollers rotate one or more times, the toner on the separation claws moves and returns to the entire surface of the fixing rollers.

Furthermore, when the toner removal period is set to be during warming up of the fixing apparatus, which is carried out before the fixing process period, and after a surface temperature of the fixing rollers has reached a softening temperature or a melting temperature of the toner, or higher, when toner that has adhered to and accumulated on the separation claws drops and returns to the surface of the fixing rollers, the toner is quickly softened or melted and damage to the peripheral components of the fixing rollers by the toner can be avoided.

Further still, when the intermittent rotation of the fixing rollers is performed at a period such that the separation claw on the surface of the fixing roller vibrates, for example when a rotation time of the fixing rollers for the intermittent rotation of the fixing rollers is assumed to be A and a stopping time of the fixing rollers is assumed to be B, and the rotation time A and the stopping time B are set so as to satisfy expressions (1) and (2) below, then the separation claws are reliably vibrated.

$$(2 \text{ to } 2.5)\times A \leqq B \quad (1)$$

$$2.0 \text{ sec} > B > 6.0 \text{ sec} \quad (2)$$

Furthermore, when a face of the separation claw opposing the surface of the fixing roller is a convex shape, only a central area of the face of the separation claws opposing the surface of the fixing rollers comes in contact with the fixing rollers, thus facilitating vibration of the separation claws.

Further still, when a gap between the surface of the fixing roller and a leading edge of the separation claw is narrower than a thickness of the recording paper, it becomes difficult for the recording paper to enter the gap between the surface of the fixing roller and the leading edge of the separation claw and enables jams and the like caused by the recording paper entering the gap to be prevented.

Furthermore, when a portion of a convex face of the separation claw contacts the surface of the fixing roller, vibration of the separation claws is facilitated as mentioned above.

Further still, when the fixing rollers are intermittently rotated, the intermittent rotation of the fixing rollers is transmitted to the separation claws such that the separation claws vibrate reliably.

DESCRIPTION OF THE PREFERRED EMBODIMENTS

Hereinafter, an embodiment of the present invention is described in detail with reference to the accompanying drawings.

Figure 1:
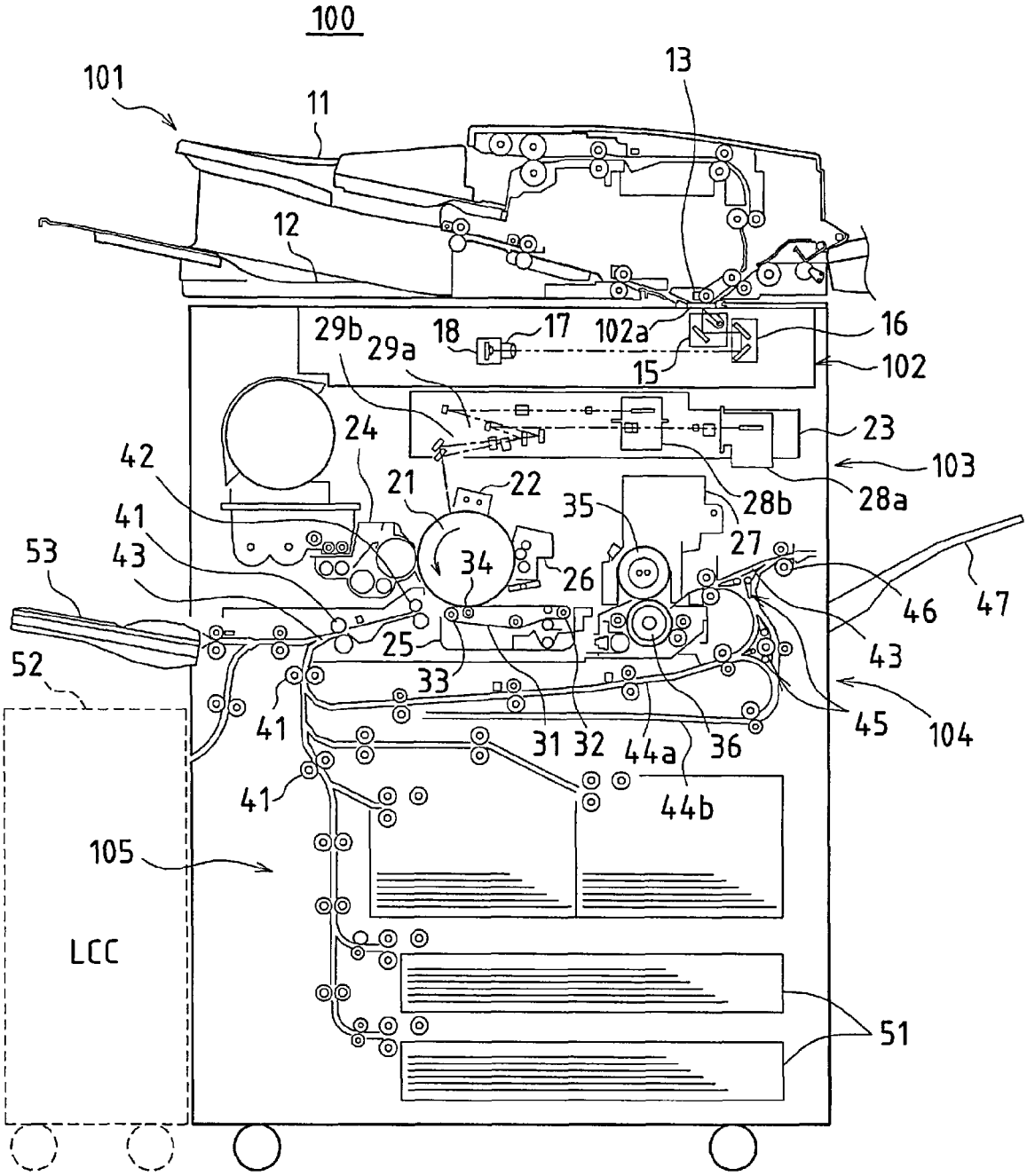
FIG. 1 is a schematic view of an image forming apparatus in which one embodiment of a fixing apparatus according to the present invention has been applied.

FIG. 1 is a schematic view of an image forming apparatus in which one embodiment of a fixing apparatus according to the present invention has been applied. An image forming apparatus 100 obtains image data that has been read from an original paper or obtains image data that has been received from outside, and forms a monochrome image represented by the image data on recording paper, and its structure can be broadly divided into an original paper transport portion (ADF) 101, an image reading portion 102, a print portion 103, a paper transport portion 104, and a paper feed portion 105.

When at least one sheet of an original paper is set in an original setting tray 11 in the original paper transport portion 101, the original paper is withdrawn and transported from the original setting tray 11 sheet by sheet, and the original paper is guided to and made to pass through an original reading window 102*a* of the image reading portion 102, then the original paper is discharged to a discharge tray 12.

A CIS (contact image sensor) 13 is arranged above the original reading window 102*a*. When the original paper passes over the original reading window 102*a*, the CIS 13 repetitively reads in a main scanning direction an image of a back face of the original paper and outputs image data that represents an image of the back face of the original paper.

Furthermore, when the original paper passes over the original reading window 102*a*, the image reading portion 102 uses a lamp of a first scanning unit 15 to expose the front face of the original paper, then guides reflected light from the front face of the original paper to an imaging lens 17 using mirrors of the first scanning unit 15 and a second scanning unit 16, and an image of the front face of the original paper is imaged onto a CCD (charge coupled device) 18 by the imaging lens 17. The CCD 18 repetitively reads in a main scanning direction an image of the front face of the original paper and outputs image data that represents an image of the front face of the original paper.

Further still, in a case where the original paper is placed onto a glass platen of an upper surface of the image reading portion 102, the first scanning unit 15 and the second scanning unit 16 are caused to move while maintaining a predetermined velocity relationship such that the front face of the original paper on the glass platen is exposed by the first scanning unit 15 and reflected light from the front face of the original paper is guided to the imaging lens 17 by the first scanning unit 15 and the second scanning unit 16, and an image of the front face of the original paper is imaged onto the CCD 18 by the imaging lens 17.

Image data that has been outputted from the CIS 13 or the CCD 18 undergoes various types of image processing by a control circuit such as a microcomputer and is then outputted to the print portion 103.

The print portion 103 is for recording an original, which is represented by image data, onto paper, and is provided with components such as a photosensitive drum 21, a charging unit 22, an optical writing unit 23, a development unit 24, a transfer unit 25, a cleaning unit 26, and a fixing apparatus 27.

The photosensitive drum 21 rotates in one direction and after its surface is cleaned by the cleaning unit 26, its surface is uniformly charged by the charging unit 22. The charging unit 22 may be a charger type unit or may be a roller type or brush type unit that makes contact with the photosensitive drum 21.

The optical writing unit 23 is a laser scanning unit (LSU) provided with two laser irradiation portions 28*a* and 28*b*, and two mirror groups 29*a* and 29*b*. The optical writing unit 23 receives as input image data and emits laser beams corresponding to the image data from the laser irradiation portions 28*a* and 28*b* respectively, then these laser beams are irradiated on the photosensitive drum 21 via the mirror groups 29*a* and 29*b* so that the uniformly charged surface of the photosensitive drum 21 is exposed so as to form an electrostatic latent image on the surface of the photosensitive drum 21.

To support high speed print processing, the optical writing unit 23 employs a two beam system provided with the two laser irradiation portions 28*a* and 28*b* such that the load along with speeding up of the irradiation timing is decreased.

It should be noted that instead of the laser scanning unit, an EL writing head or an LED writing head in which light-emitting elements are lined up in an array may be used as the optical writing unit 23.

The development unit 24 supplies toner to the surface of the photosensitive drum 21 to develop the electrostatic latent image and form a toner image on the surface of the photosensitive drum 21. The transfer unit 25 transfers the toner image on the surface of the photosensitive drum 21 to the recording paper that has been transported by the paper transport portion 104. The fixing apparatus 27 applies heat and pressure to the recording paper to cause the toner image to fix onto the recording paper. After this, the recording paper is further transported and discharged to a discharge tray 47 by the paper transport portion 104. Furthermore, the cleaning unit 26 removes and collects toner that is residual on the surface of the photosensitive drum 21 after development and transfer.

Here, the transfer unit 25 is provided with such components as a transfer belt 31, a drive roller 32, an idler roller 33, and an elastic conductive roller 34, and the transfer belt 31 is caused to rotate while spanning the rollers 32 to 34 and other rollers in a tensioned state. The transfer belt 31 has a predetermined resistance value (for example, $1\times10^{9}$ to $1\times10^{13}$ Ω/cm) and transports recording paper that has been placed on its surface. The elastic conductive roller 34 presses against the surface of the photosensitive drum 21 with interposition of the transfer belt 31 and presses the recording paper on the transfer belt 31 against the surface of the photosensitive drum 21. An electric field of a reverse polarity to the charge of the toner image on the surface of the photosensitive drum 21 is applied to the elastic conductive roller 34, and the toner image on the surface of the photosensitive drum 21 is transferred to the recording paper on the transfer belt 31 due to the reverse polarity electric field. For example, when the toner image has a charge of a negative (−) polarity, the elastic conductive roller 34 is subjected to an electric field having a positive (+) polarity.

The fixing apparatus 27 is provided with a hot roller 35 and a pressure roller 36. A pressure-applying member not shown in the drawings is arranged at both ends of the pressure roller 36 so that the pressure roller 36 is pressed into contact with the hot roller 35 with a predetermined pressure. When the recording paper is transported to a pressure-contact region (referred to a nip region N) between the hot roller 35 and the pressure roller 36, the unfixed toner image on the recording paper is subjected to thermal fusing and pressure while the recording paper is being transported by the rollers 35 and 36 such that the toner image fixes to the recording paper.

The paper transport portion 104 is provided with components such as a plurality of pairs of transport rollers 41 for transporting the recording paper, a pair of registration rollers 42, a transport path 43, reverse transport paths 44*a* and 44*b*, a plurality of branching claws 45, and a pair of discharge rollers 46.

In the transport path 43, the recording paper is taken in from the paper feed portion 105, then the recording paper is transported until the leading edge of the recording paper reaches the registration rollers 42. At this time the registration rollers 42 are being temporarily stopped, and therefore the leading edge of the recording paper reaches and contacts the registration rollers 42 and the recording paper flexes. Due to the elastic force of the flexed recording paper, the leading edge of the recording paper aligns in parallel to the registration rollers 42. After this, rotation of the registration rollers 42 commences and the recording paper is transported by the registration rollers 42 to the transfer unit 25 of the print portion 103, then the recording paper is further transported by the discharge rollers 46 to the discharge tray 47.

Stopping and rotation of the registration rollers 42 can be achieved by switching on and off a clutch between the registration rollers 42 and their drive shafts or by switching on and off the motor that is the drive source of the registration rollers 42.

Furthermore, when an image is to be recorded to the back face of the recording paper also, the branching claws 45 are selectively switched so that the recording paper is guided from the transport path 43 into the reverse transport path 44*b*, then transport of the recording paper is caused to stop temporarily, and the branching claws 45 are again selectively switched so that the recording paper is guided from the reverse transport path 44*b* into the reverse transport path 44*a*, and after the front and back faces of the recording paper have been reversed, the recording paper returns to the registration rollers 42 of the transport path 43 via the reverse transport path 44*a*.

This manner of transporting the recording paper is referred to as switchback transporting, and switchback transporting allows the front and back faces of the recording paper to be reversed and at the same time switches the leading edge and the trailing edge of the recording paper. Consequently, when the recording paper is turned over and returned, the trailing edge of the recording paper makes contact with the registration rollers 42 such that the trailing edge of the recording paper aligns in parallel to the registration rollers 42, then the recording paper is transported from its trailing edge by the registration rollers 42 to the transfer unit 25 of the print portion 103 and printing is carried out on the back face of the recording paper, then the unfixed toner image on the back face of the recording paper is subjected to thermal fusing and pressure by the nip region between the rollers 35 and 36 of the fixing apparatus 27 such that the toner image fixes onto the back face of the recording paper, after which the recording paper is transported to the discharge tray 47 by the discharge rollers 46.

Sensors that detect the position and the like of the recording paper are arranged in various locations in the transport path 43 and the reverse transport paths 44*a* and 44*b*, and the transport and positioning of the recording paper are carried out by drive controlling the transport rollers and the registration rollers based on the positions of the recording paper detected by the various sensors.

The paper feed portion 105 is provided with a plurality of paper feed trays 51. Each of the paper feed trays 51 is a tray for storing recording paper and these are provided below the image forming apparatus 100. Furthermore, each of the paper feed trays 51 is provided with a pickup roller or the like for withdrawing the recording paper sheet by sheet and recording paper that has been withdrawn is fed to the transport path 43 of the paper transport portion 104.

Since the image forming apparatus 100 is aimed at high speed print processing, each of the paper feed trays 51 has a capacity capable of storing from 500 to 1,500 sheets of standard size recording papers.

Furthermore, at a lateral surface of the image forming apparatus 100 are provided a large capacity cassette (LCC) 52, which makes it possible to store large volumes of multiple types of recording paper, and a manual paper feed tray 53 for supplying recording paper of mainly nonstandard sizes.

The discharge tray 47 is arranged at a lateral surface of an opposite side to the manual paper feed tray 53. Instead of the discharge tray 47, configurations in which post processing devices of the recording paper to be discharged (stapling, punching and the like) or a plurality of levels of discharge trays are arranged as options are also possible.

The usefulness of the image forming apparatus 100 is improved by increasing the print processing speed. For example, when using standard A4 size recording paper, the transport speed of the recording paper is set to 70 sheets/min (a processing speed of 350 mm/sec).

When the transport speed or the processing speed of the recording paper is increased in the fixing apparatus 27, there is a tendency for a sufficient amount of heat to become unable to be applied to the recording paper that passes through the nip region between the hot roller 35 and the pressure roller 36, and for the surface temperature of the rollers 35 and 36 to drop, and if this is ignored, deficiencies occur in the fixing of the toner image on the recording paper.

For this reason, in the fixing apparatus 27, a heater is installed internally to both the rollers 35 and 36 and the rollers 35 and 36 are heated. Furthermore, an external heating unit 148 is provided to heat the hot roller 35 from the outside thereof, and the hot roller 35 is directly heated by the external heating unit 148, and due to thermal conduction between the rollers 35 and 36, the pressure roller 36 is also heated indirectly, which suppresses drops in the surface temperature of the rollers 35 and 36 and maintains the surface temperature of these to prescribed fixing temperatures.

Figure 2:
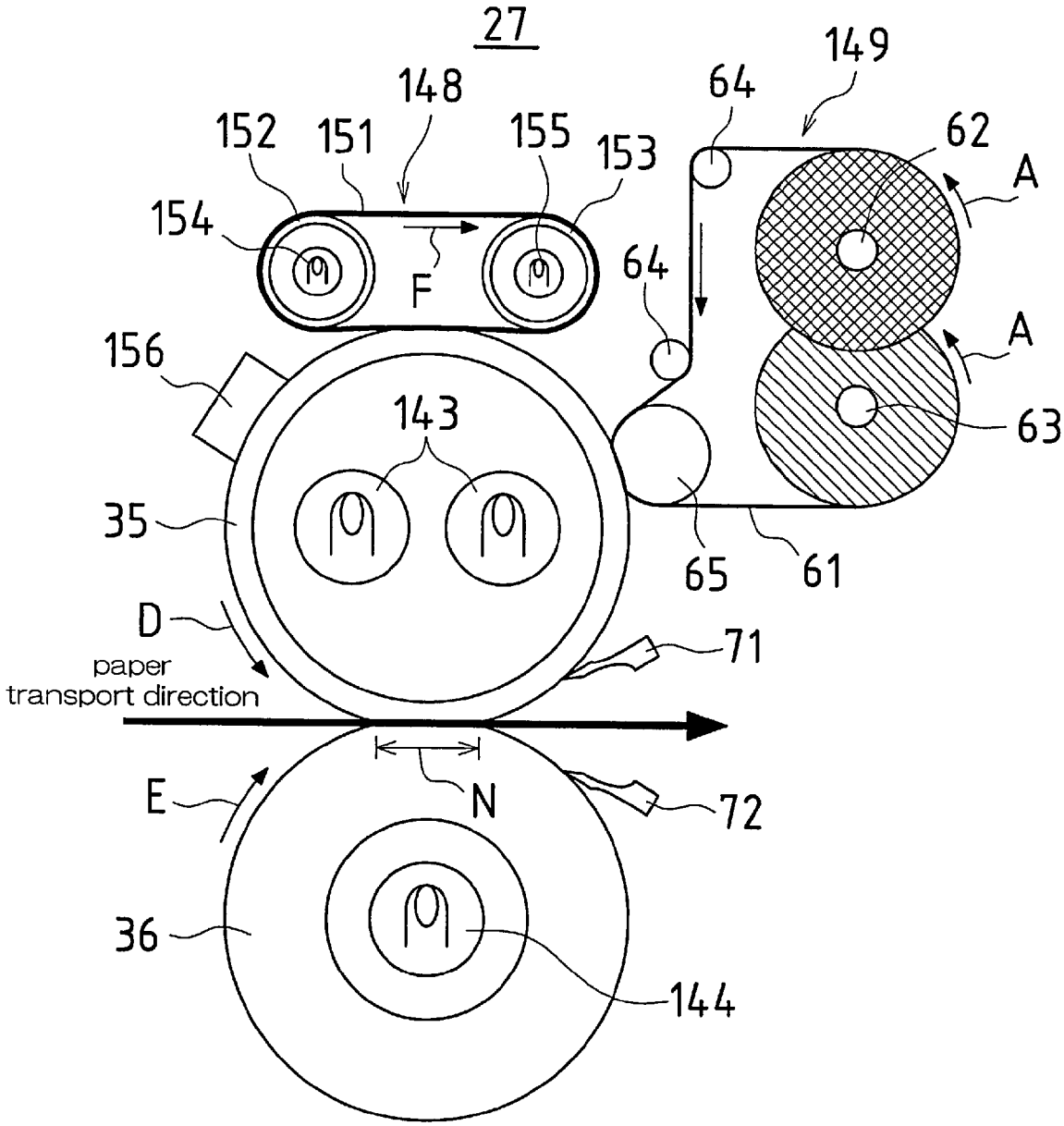
FIG. 2 is a cross-sectional view that schematically illustrates the fixing apparatus of the present embodiment as viewed laterally.

FIG. 2 is a cross-sectional view that schematically illustrates the fixing apparatus 27 as viewed laterally. The fixing apparatus 27 is provided with the hot roller 35, the pressure roller 36, the external heating unit 148 that heats the hot roller 35 from the outside, a cleaning apparatus 149 for removing toner that has adhered to the surface of the hot roller 35, and separation claws 71 and 72 respectively provided at a surface of the rollers 35 and 36.

The rollers 35 and 36 press against each other with a predetermined pressing force (for example, 600 N) and a nip region N is formed between these. The length of the nip region N (the length along the rotation direction of the rollers 35 and 36) is set to 9 mm for example. The rollers 35 and 36 rotate while being heated to a prescribed fixing temperature (for example 180° C.) and a toner image on recording paper P that passes through the nip region N is thermally fused.

The hot roller 35 is a roller having a three-layer construction in which an elastic layer is provided on the outer surface of the core and a mold release layer is formed on the outer surface of the elastic layer. A metal such as iron, stainless steel, aluminum, or bronze for example, or an alloy of these or the like, is used for the core. Furthermore, a silicone rubber is used for the elastic layer, and a fluorocarbon resin such as PFA (a copolymer of tetrafluoroethylene and perfluoroalkyl vinyl ether) and PTFE (polytetrafluoroethylene) is used for the mold release layer.

A heater lamp (halogen lamp) 143, which is a heat source for heating the hot roller 35, is provided inside the hot roller 35 (inside the core).

The pressure roller 36 is also a roller having a three-layer construction equivalent to the hot roller 35 and is constituted by a core of a metal such as iron, stainless steel, aluminum, or bronze or an alloy of any of these, an elastic layer of a silicone rubber or the like on a surface of the core, and further still a mold release layer thereon of PFA or PTFE or the like.

Furthermore, a heater lamp 144 for heating the pressure roller 36 is also provided inside the pressure roller 36 (inside the core).

The heater lamps 143 and 144 of the rollers 35 and 36 are subjected to on-off control and infrared rays are radiated during ON times to heat the rollers 35 and 36 respectively. The rollers 35 and 36 are heated from within and their surfaces are uniformly heated.

The external heating unit 148 is provided with an endless heating belt 151 and a pair of external hot rollers 152 and 153. The endless heating belt 151 spans in tensioned state between the external hot rollers 152 and 153.

The endless heating belt 151 is a belt having a two-layer construction in which a mold release layer constituted by a synthetic resin material having excellent heat resistance and releasability (a fluorocarbon resin such as PFA and PTFE for example) is formed on a surface of a hollow cylindrical base material constituted by a heat resistant resin such as polyimide or a metal material such as stainless steel or nickel. A coating of fluorocarbon resin or the like may be provided on an inner surface of the belt base material to reduce the exertive force of the endless heating belt 151.

The external hot rollers 152 and 153 are hollow cylindrical metal core materials constituted by aluminum or a ferrous material or the like. A coating of fluorocarbon resin or the like may be provided on a surface of the metal core material to reduce the exertive force of the endless heating belt 151.

Furthermore, heater lamps 154 and 155 are provided inside the external hot rollers 152 and 153 respectively to heat the rollers 152 and 153. The heater lamps 154 and 155 are subjected to on-off control and infrared rays are radiated during ON times to heat the rollers 152 and 153 respectively. The rollers 152 and 153 are heated from within and their surfaces are uniformly heated. Then, thermal conduction is implemented from the surfaces of the rollers 152 and 153 to the endless heating belt 151 and the entire endless heating belt 151 is heated uniformly when the endless heating belt 151 rotates with the rollers 152 and 153.

A thermistor 156 is arranged in a vicinity of the surface of the hot roller 35 and the surface temperature of the hot roller 35 is detected by the thermistor 156.

Here, the shaft of the hot roller 35 is rotationally driven by a motor and a power transmission mechanism or the like (not shown in drawings) and rotates in a direction indicated by arrow D. Due to being in pressed contact with the hot roller 35, the pressure roller 36 is idly rotated in a direction indicated by arrow E. Furthermore, the endless heating belt 151 of the external heating unit 148 is idly rotated in a direction indicated by arrow F when it is in contact with the hot roller 35. In this way, the hot roller 35, the pressure roller 36, and the endless heating belt 151 rotate in mutual synchronization.

Furthermore, based on the surface temperature of the hot roller 35 detected by the thermistor 156, the heater lamps 143 and 144 of the hot roller 35 and the pressure roller 36 and the heater lamps 154 and 155 of the external hot rollers 152 and 153 are subjected to on-off control so as to regulate the surface temperatures of the hot roller 35 and the pressure roller 36 and the surface temperature of the endless heating belt 151. In this way, the surface temperatures of the rollers are controlled appropriately and the tone image on the recording paper can be fixed reliably.

On the other hand, when the print processing sheet number is increased, the total amount of residual toner adhered to the hot roller 35 also increases, and residual toner on the hot roller 35 cannot be removed reliably using cleaning such as blade cleaning or felt cleaning. For this reason, the cleaning apparatus 149 is applied.

The cleaning apparatus 149 is provided with a feed-out roller 62 onto which is wound a web sheet 61 constituted by a thin cloth (approximately 100 μm thick) permeated with an oil (silicone oil), a take-up roller 63 to which the leading edge of the web sheet 61 is connected, a plurality of tension rollers 64 that apply tension to the web sheet 61 along the transport path of the web sheet 61 from the feed-out roller 62 to the take-up roller 63, and a pressing roller 65 that presses the web sheet 61 between the feed-out roller 62 and the take-up roller 63 onto the hot roller 35, and residual toner adhering to the surface of the hot roller 35 is wiped off and removed by the web sheet 61 being pressed against the surface of the hot roller 35 by the pressing roller 65.

The web sheet 61 is pressed against the surface of the hot roller 35 by the pressing roller 65 at a nip region between the pressing roller 65 and the hot roller 35. A portion of the web sheet 61 at the nip region becomes soiled by residual toner on the surface of the hot roller 35, and when removal of residual toner by this portion of the web sheet 61 becomes difficult, the feed-out roller 62 and the take-up roller 63 are rotated by a fixed amount so that the web sheet 61 is fed out from the feed-out roller 62 to the take-up roller 63 by a fixed amount, thereby renewing the portion of the web sheet 61 at the nip region and making it possible to remove residual toner with this new portion of the web sheet 61.

Furthermore, for each time a fixed amount of toner is consumed, it is deemed that removal of residual toner by the portion of the web sheet 61 at the nip region has become difficult, and the feed-out roller 62 and the take-up roller 63 are rotated by a fixed amount to renew the portion of the web sheet 61 at the nip region. Consequently, the feed-out roller 62 and the take-up roller 63 are intermittently rotationally driven.

It should be noted that although toner also adheres to the surface of the pressure roller 36, the toner on the surface of the pressure roller 36 moves to the surface of the hot roller 35 at the nip region N, after which it is removed by the cleaning apparatus 149.

Next, the separation claws 71 and 72 are arranged on a downstream side from the nip region N in the rotation direction of the rollers 35 and 36 respectively. The separation claws 71 and 72 are oscillatably or elastically supported near their base ends, and the leading edge sides of the separation claws 71 and 72 are biased toward the rollers 35 and 36 due to elastic members respectively such that the leading edge vicinity of each of the separation claws 71 and 72 presses lightly against the surface of the rollers 35 and 36 respectively. When recording paper is wound onto either of the rollers 35 and 36, the leading edge of the recording paper is separated by the leading edge of either of the separation claws 71 and 72 and the recording paper is peeled off from the roller surface. In this way, jamming of the recording paper is prevented.

However, since the separation claw 71 is provided upstream from the cleaning apparatus 149 in the rotation direction of the hot roller 35, a portion of toner on the surface of the hot roller 35 adheres to the separation claw 71 before the toner on the surface of the hot roller 35 is removed by the cleaning apparatus 149. Also, a portion of the toner on the surface of the pressure roller 36 also adheres to the separation claw 72.

If toner that has adhered to the separation claws 71 and 72 in this manner is left as it is, the amount of toner adhered to the separation claws 71 and 72 increases, and when the separation claws 71 and 72 contact the leading edge of the recording paper that has passed through the nip region N, the toner on the separation claws 71 and 72 moves to the leading edge of the recording paper and smears the leading edge of the recording paper, or a lump of toner that has adhered to and accumulated on the separation claws 71 and 72 may drop and adhere to the surface of the hot roller 35 or the pressure roller 36, thereby smearing the recording paper and become a cause of damage to peripheral components such as the thermistors 156 arranged along the surface of the rollers.

Accordingly, in the fixing apparatus 27 of the present embodiment, a predetermined period different from the fixing process period (corresponding to a fixing process step) in which fixing of the toner to the recording paper is carried out is set as a toner removal period (corresponding to a toner removal step), and during the toner removal period the hot roller 35 and the pressure roller 36 are intermittently rotated, and the separation claws 71 and 72 in contact with the rollers 35 and 36 are caused to vibrate by the intermittent rotation of the rollers 35 and 36 such that toner adhering to the separation claws 71 and 72 is caused to drop due to this and is removed. As a result, toner that has adhered to and accumulated on the separation claws 71 and 72 can be removed by setting a toner removal period without impeding the fixing process period.

Figure 3:
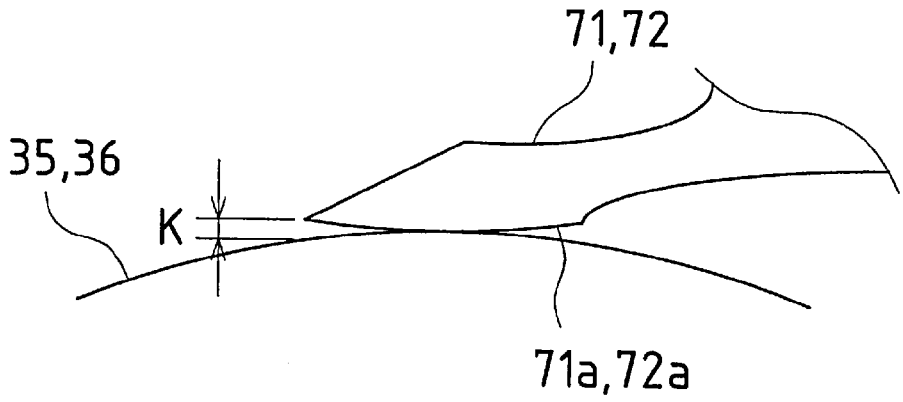
FIG. 3 is a side view illustrating a separation claw in the fixing apparatus of FIG. 2.

Furthermore, as shown in FIG. 3, surfaces 71*a* and 72*a* of the separation claws 71 and 72 that oppose the surfaces of the rollers 35 and 36 are set in a convex shape. In this way, only a central vicinity area of the surfaces 71*a* and 72*a* of the separation claws 71 and 72 makes contact with the rollers 35 and 36 respectively, and it becomes easier for the separation claws 71 and 72 to vibrate.

Note however that a gap K between the rollers 35 and 36 and the separation claws 71 and 72 is set narrower than a thickness of the recording paper. This makes it difficult for the recording paper to enter the gap K and enables jams and the like caused by the recording paper entering the gap K to be prevented.

Here, the toner removal period is set to be, for example, during the warming up of the image forming apparatus 100 and the fixing apparatus 27, and after the surface temperature of the hot roller 35 detected by the thermistor 156 has reached a softening temperature or a melting temperature of the toner, or higher. In this way, when toner that has adhered to and accumulated on the separation claws 71 and 72 drops and returns to the surfaces of the rollers 35 and 36, the lump of toner is quickly softened or melted and damage to the peripheral components of the rollers 35 and 36 by the lump of toner can be avoided. Furthermore, removal of toner on the surface of the hot roller 35 by the cleaning apparatus 149 can be carried out efficiently.

Alternatively, the toner removal period is set to be after the fixing process period. In this case, the surface temperature of the hot roller 35 continues to be maintained at or above the softening temperature or the melting temperature of the toner, and therefore the lump of toner that return to the surfaces of the rollers 35 and 36 from the separation claws 71 and 72 are quickly softened or melted so that damage to the peripheral components of the rollers 35 and 36 can be avoided. Furthermore, removal of toner on the surface of the hot roller 35 by the cleaning apparatus 149 can be carried out efficiently.

Figure 4:
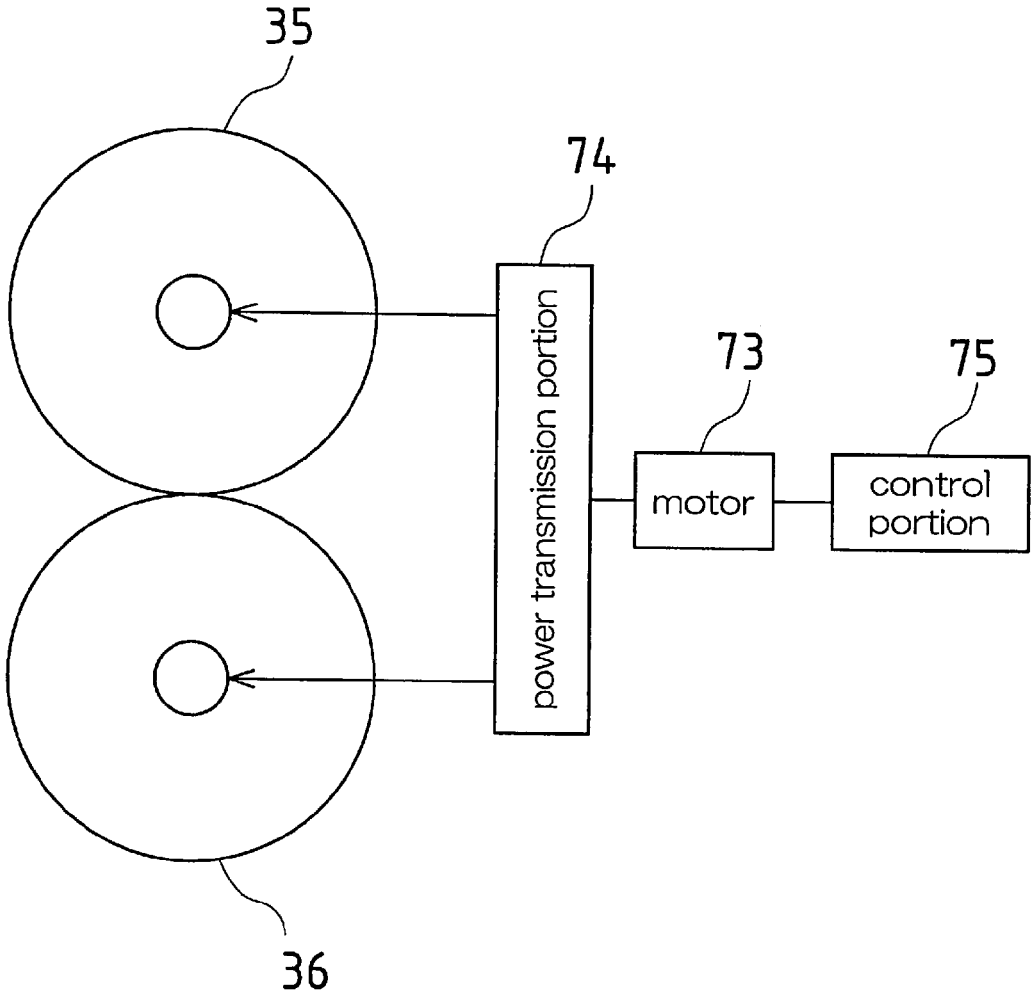
FIG. 4 schematically illustrates a drive control system of the fixing apparatus of FIG. 2.

FIG. 4 schematically illustrates a drive control system of the fixing apparatus 27 of the present embodiment. A rotational driving force of the motor 73 is transmitted to the hot roller 35 and the pressure roller 36 through a power transmission portion 74 to rotationally drive the hot roller 35 and the pressure roller 36. A control portion 75 performs drive control on the motor 73 to control the rotational velocity or rotational state of the hot roller 35 and the pressure roller 36.

In the fixing process period, in which toner is fixed onto the recording paper, the control portion 75 performs constant rotation drive control on the motor 73 such that the hot roller 35 and the pressure roller 36 are caused to rotate constantly, and toner is fixed onto the recording paper while the recording paper is transported at a fixed velocity by the rollers 35 and 36.

And in the toner removal period, in which toner that has adhered to and accumulated to the separation claws 71 and 72 is removed, the control portion 75 performs intermittent rotation drive control on the motor 73 such that the hot roller 35 and the pressure roller 36 are driven intermittently. In this way, the separation claws 71 and 72 vibrate and toner that has adhered to and accumulated on the separation claws 71 and 72 is removed.

Figure 5:
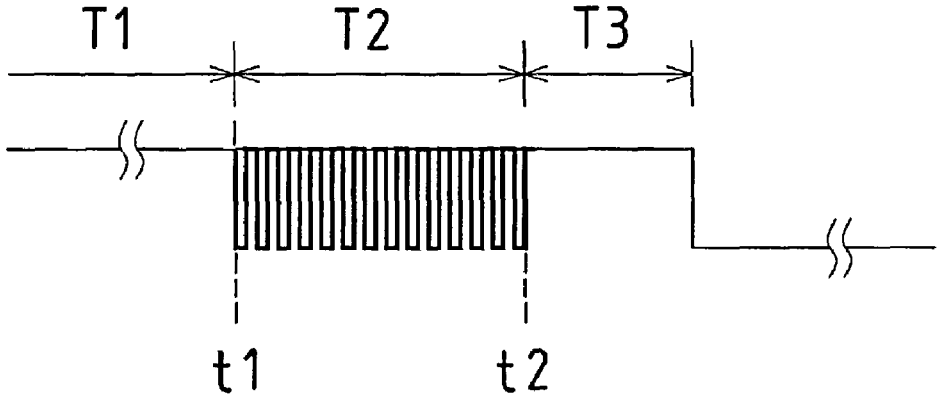
FIG. 5 is a timing chart showing a control process by the drive control system of FIG. 4.
Figure 6:
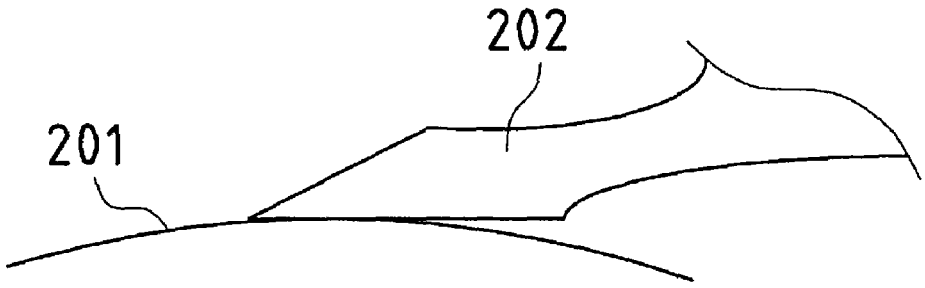
FIG. 6 is a side view illustrating a conventional separation claw.

For example, as shown in FIG. 5, when a toner removal period T2 is set to be from a time point t1 immediately after a fixing process period T1, the control portion 75 commences intermittent rotation drive control of the motor 73 at the time point t1, thereby causing the hot roller 35 and the pressure roller 36 to be intermittently rotated. The toner removal period T2 is set to a period for example in which the hot roller 35 and the pressure roller 36 can rotate one or more times. Consequently, the intermittent rotation of the hot roller 35 and the pressure roller 36 continues until the rollers 35 and 36 have rotated one or more times. This allows the toner that has adhered to and accumulated on the separation claws 71 and 72 to move and return to the entire surface of the hot roller 35 and the pressure roller 36.

Further still, the control portion 75 performs constant rotation drive control on the motor 73 for a fixed period T3 from a time point t2 at which the toner removal period T2 has finished, thereby causing the hot roller 35 and the pressure roller 36 to rotate constantly. Due to the rotation of the hot roller 35 and the pressure roller 36 in the fixed period T3, toner that has finally moved from the separation claw 71 to the surface of the pressure roller 36 just before the finish of the toner removal period T2 reaches the nip region N and moves to the surface of the hot roller 35, then further reaches the cleaning apparatus 149 and is removed by the cleaning apparatus 149. That is, the fixed period T3 is set to at least a time from when toner that has adhered to and accumulated to the separation claw 71 moves to the surface of the pressure roller 36 until it moves to the surface of the hot roller 35 at the nip region N and reaches the cleaning apparatus 149.

The period of intermittent rotation of the hot roller 35 and the pressure roller 36 is set so that vibration of the separation claws 71 and 72 is reliably produced. In tests that were carried out it became evident that the presence/absence and amplitude of vibrations produced in the separation claws 71 and 72 were dependent on the period of intermittent rotation of the hot roller 35 and the pressure roller 36. For this reason, a period of intermittent rotation of the hot roller 35 and the pressure roller 36 has been determined in advance to ensure vibration of the separation claws 71 and 72 would be produced reliably and also those vibrations would be large, and intermittent rotation drive control is performed on the motor 73 so that the hot roller 35 and the pressure roller 36 is intermittently rotated in this period.

As a result of testing, it is evident that if a rotation time of the rollers 35 and 36 in the intermittent rotation of the rollers 35 and 36 is assumed to be A and the stopping time of the rollers 35 and 36 is assumed to be B, the separation claws 71 and 72 vibrate reliably when the rotation time A and the stopping time B satisfy the following expressions (1) and (2).

$$(2 \text{ to } 2.5)\times A \leqq B \quad (1)$$

$$2.0 \text{ sec} > B > 6.0 \text{ sec} \quad (2)$$

Further still, as a result of testing, it is evident that the separation claws 71 and 72 vibrate most favorably when the rotation time A and the stopping time B are set at 5 seconds each. Thus, it is preferable that the rotation time A and the stopping time B are set at 5 seconds each.

It should be noted that the present invention is not limited to the above-described embodiment, but includes other various variations. For example, a cleaning apparatus that removes toner from the surface of the pressure roller 36 may also be provided on the pressure roller 36 side. Furthermore, the heater lamp 144 of the pressure roller 36 may be omitted. In this case, the temperature of the separation claw 72 of the pressure roller 36 tends to become low such that toner on the surface of the pressure roller 36 moves to the separation claw 72 and hardens so as to more easily become adhered there, for which application of the present invention is very preferable.

The present invention can be embodied and practiced in other different forms without departing from the purport and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A roller drive control method of a fixing apparatus in which a separation claw for separating recording paper is arranged in a vicinity of a surface of at least one of fixing rollers that sandwich and transport the recording paper to cause toner to fix onto the recording paper, the roller drive control method comprising:

a fixing process step of carrying out fixing of toner onto the recording paper in a fixing process period, and a toner removal step of removing toner adhered to the separation claw, in a toner removal period, which is different from the fixing process period, wherein the toner removal period is set to be after a surface temperature of the fixing rollers has reached a softening temperature or a melting temperature of the toner, or higher, and wherein at least one of the fixing rollers is rotationally driven such that a rotational state of the fixing rollers is different in the fixing process step and the toner removal step, and the fixing rollers intermittently rotate at multiple intervals in the toner removal period, the intermittent rotation of the fixing rollers being performed at a frequency such that the separation claw on the surface of the fixing roller vibrates.

2. The roller drive control method of a fixing apparatus according to claim 1, wherein the toner removal period is set to be during warming up of the fixing apparatus, which is carried out before the fixing process period, or after the fixing process period.

3. The roller drive control method of a fixing apparatus according to claim 1, wherein the toner removal period is set to a period in which the fixing rollers can rotate one or more times.

4. The roller drive control method of a fixing apparatus according to claim 1, wherein when a rotation time of the fixing rollers for the intermittent rotation of the fixing rollers is assumed to be A and a stopping time of the fixing rollers is assumed to be B, the rotation time A and the stopping time B are set so as to satisfy expressions (1) and (2) below:

$$(2 \text{ to } 2.5)\times A \leqq B \quad (1)$$

$$2.0 \text{ sec} > B > 6.0 \text{ sec} \quad (2).$$

5. The roller drive control method of a fixing apparatus according to claim 1, wherein a face of the separation claw opposing the surface of the fixing roller is a convex shape.

6. A fixing apparatus, comprising:

fixing rollers that sandwich and transport recording paper to cause toner to fix onto the recording paper, and a separation claw that is arranged in a vicinity of a surface of at least one of the fixing rollers for separating the recording paper and whose face opposing the surface of the fixing roller is a convex shape, wherein a toner removal period is set to be after a surface temperature of the fixing rollers has reached a softening temperature or a melting temperature of the toner, or higher, and wherein at least one of the fixing rollers is rotationally driven such that the fixing rollers intermittently rotate at multiple intervals in the toner removal period, the intermittent rotation of the fixing rollers being performed at a frequency such that the separation claw on the surface of the fixing roller vibrates.

7. The fixing apparatus according to claim 6, wherein a gap between the surface of the fixing roller and a leading edge of the separation claw is narrower than a thickness of the recording paper.

8. The fixing apparatus according to claim 6, wherein a portion of a convex face of the separation claw contacts the surface of the fixing roller.

* * * * *